US009318284B2

(12) United States Patent
Fasano et al.

(10) Patent No.: US 9,318,284 B2
(45) Date of Patent: Apr. 19, 2016

(54) LOW-PROFILE CIRCUIT BREAKER

(71) Applicants: Michael Fasano, Watertown, CT (US); Jianzhuan Lin, West Hartford, CT (US); James Bugryn, Bristol, CT (US)

(72) Inventors: Michael Fasano, Watertown, CT (US); Jianzhuan Lin, West Hartford, CT (US); James Bugryn, Bristol, CT (US)

(73) Assignee: CARLING TECHNOLOGIES, INC., Plainville, CT (US)

( * ) Notice: Subject to any disclaimer, the term of this patent is extended or adjusted under 35 U.S.C. 154(b) by 289 days.

(21) Appl. No.: 13/743,932

(22) Filed: Jan. 17, 2013

(65) Prior Publication Data

US 2013/0180956 A1 Jul. 18, 2013

Related U.S. Application Data

(60) Provisional application No. 61/587,733, filed on Jan. 18, 2012.

(51) Int. Cl.

| | |
|---|---|
| ***H01H 33/20*** | (2006.01) |
| ***H01H 9/34*** | (2006.01) |
| ***H01H 71/02*** | (2006.01) |

(52) U.S. Cl.

CPC ..... *H01H 33/20* (2013.01); *H01H 9/345* (2013.01); *H01H 71/025* (2013.01)

(58) Field of Classification Search

CPC ..... H01H 9/345; H01H 71/025
USPC ..... 218/15–20, 34–36, 148, 149, 153–157
See application file for complete search history.

(56) References Cited

U.S. PATENT DOCUMENTS

| | | | | |
|---|---|---|---|---|
| 4,146,855 | A | 3/1979 | Schultz et al. | |
| 4,514,709 | A | 4/1985 | Nakano et al. | |
| 4,612,426 | A | 9/1986 | Maier et al. | |
| 5,548,258 | A * | 8/1996 | Kuboyama et al. | 335/16 |
| 5,569,894 | A * | 10/1996 | Uchida et al. | 218/27 |
| 5,753,878 | A * | 5/1998 | Doughty et al. | 218/157 |
| 2004/0051605 | A1 | 3/2004 | Fasano | |

OTHER PUBLICATIONS

International Search Report and Written Opinion of the International Searching Authority Application No. PCT/US2013/022078 Completed: Mar. 6, 2013; Mailing Date: Mar. 25, 2013 6 pages.

* cited by examiner

*Primary Examiner* — Amy Cohen Johnson
*Assistant Examiner* — Marina Fishman
(74) *Attorney, Agent, or Firm* — St. Onge Steward Johnston & Reens, LLC

(57) ABSTRACT

A circuit interrupter having a compact design. According to some implementations, the circuit interrupter includes a conductor from a terminal to a contact having a portion that is angled with respect to the housing sides. This allows a fastener sleeve used to secure the device housing to be positioned closer to the center of mass of the housing, reducing the area of the housing. In some implementations, an arc splitter is provided which includes conductive plates that are angled with respect to the housing sides, allowing the area of the housing to be reduced. In some implementations, a terminal is designed to accommodate a connection without being doubled back, reducing the clearance required for the terminal and the overall area of the circuit interrupter.

19 Claims, 3 Drawing Sheets

LOW-PROFILE CIRCUIT BREAKER

FIELD OF THE INVENTION

The present invention relates generally to an ultra low profile circuit breaker, and more specifically, relates to a circuit breaker having an improved design that allows for a more compact circuit breaker.

BACKGROUND OF THE INVENTION

A circuit interrupter is an electrical component that can break an electrical circuit, interrupting the current. A basic example of a circuit interrupter is a switch, which generally consists of two electrical contacts in one of two states; either closed meaning the contacts are touching and electricity can flow between them, or open, meaning the contacts are separated. A switch may be directly manipulated by a human as a control signal to a system, such as a computer keyboard button, or to control power flow in a circuit, such as a light switch.

A second example of a circuit interrupter is a circuit breaker. A circuit breaker is used in an electrical panel that monitors and controls the amount of amperes (amps) being sent through the electrical wiring. A circuit breaker is designed to protect an electrical circuit from damage caused by an overload or a short circuit. If a power surge occurs in the electrical wiring, the breaker will trip. This will cause a breaker that was in the "on" position to flip to the "off" position and shut down the electrical power leading from that breaker. When a circuit breaker is tripped, it may prevent a fire from starting on an overloaded circuit; it can also prevent the destruction of the device that is drawing the electricity.

A standard circuit breaker has a line and a load. Generally, the line is the incoming electricity, most often from a power company. This can sometimes be referred to as the input into the circuit breaker. The load, sometimes referred to as the output, feeds out of the circuit breaker and connects to the electrical components being fed from the circuit breaker. There may be an individual component connected directly to a circuit breaker, for example only an air conditioner, or a circuit breaker may be connected to multiple components through a power wire which terminates at electrical outlets.

A circuit breaker can be used as a replacement for a fuse. Unlike a fuse, which operates once and then has to be replaced, a circuit breaker can be reset (either manually or automatically) to resume normal operation. Fuses perform much the same duty as circuit breakers, however, circuit breakers are safer to use than fuses and easier to fix. If a fuse blows, oftentimes a person will not know which fuse controls which specific power areas. The person will have to examine the fuses to determine which fuse appears to be burned or spent. The fuse will then have to be removed from the fuse box and a new fuse will have to be installed.

Circuit breakers are much easier to fix than fuses. When the power to an area shuts down, the person can look in the electrical panel and see which breaker has tripped to the "off" position. The breaker can then be flipped to the "on" position and power will resume again. In general, a circuit breaker has two contacts located inside of a housing. The first contact is stationary, and may be connected to either the line or the load. The second contact is movable with respect to the first contact, such that when the circuit breaker is in the "off", or tripped position, a gap exists between the first and second contact.

A problem with current circuit breakers is that they can be relatively bulky, requiring a large profile. The size of the circuit breaker can greatly affect the design of the component the circuit breaker will be integrated into. Specifically, a component or device may not be able to be made smaller due to the relatively large size of the circuit breaker.

As best seen in FIG. 1, a known circuit breaker 100 has a switch 105 that is used to open or close the circuit breaker. In the closed position, electricity is allowed to freely flow through circuit breaker. In case of an overload in the circuit, trip mechanism 145 may automatically trip switch 105, opening circuit breaker 100. Circuit breaker 100 has a first contact 110 which is fixed to the housing of circuit breaker 100. Circuit breaker 100 has a second contact 115 which is movable with respect to first contact 110. In the closed position second contact 115 is directly touching first contact 110. If an overload in the circuit occurs, second contact 115 is moved to a position away from first contact 110.

Circuit breaker 100 has a first terminal 120 and a second terminal 125. First terminal 120 and second terminal 125 are located on opposite sides of the housing of circuit breaker 100. Both first terminal 120 and second terminal 125 include a conductor having a straight portion running in an upward direction. Each conductor makes a 90 degree turn, the conductor from first terminal 120 turning in a direction opposite to that of second terminal 125. Each conductor then makes a second 90 degree turn in the same direction as the first 90 degree turn such that the conductor has double-backed on itself. The conductor then terminates with a screw at which a wire connection can be made.

Terminal 120 is connected to a conductor 130 which runs parallel to the side of circuit breaker 100. Conductor 130 then makes a 90 degree turn to run perpendicular to the side of circuit breaker 100. A fastener sleeve 135 is located below conductor 130 and below plane 165. The fastener sleeve may accommodate a screw, bolt, rivet or the like. Circuit breaker 100 also includes an arc splitter 140 that is perpendicular to the side of circuit breaker 100.

A problem with this known circuit breaker is that its design requires a relatively large profile in the device or component in which the circuit breaker is to be installed. As components get smaller and smaller, tenths of an inch become more important and, therefore, any shrinking of the profile of a circuit breaker is desired.

It is therefore desired to provide a circuit interrupter which addresses these deficiencies.

SUMMARY OF THE INVENTION

Accordingly, it is an object of the present invention to provide a circuit interrupter having a configuration which reduces its size.

This and other objectives are achieved by providing a circuit interrupter which includes a housing having a first contact and a second contact movable with respect to the first contact; a first terminal located on a first side of the housing; a second terminal located on a second side of the housing, the second side being opposite the first side; and an electrical conductor electrically connected to the first terminal and the first contact. The electrical conductor includes a first portion located substantially toward the first side of the housing running towards a third side of the housing, the third side being adjacent to the first side; a second portion located substantially toward the third side of the housing running towards the second side of the housing; and a third portion connecting the first portion to the second portion, the third portion being at an obtuse angle with respect to the first portion and the second portion; a fastening feature located on an intersection of a plane defined by the first portion and a plane defined by the second portion; and an arc splitter located adjacent to the first portion and the second portion of the electrical conductor, the arc splitter being angled with respect to the second side; wherein the first terminal and the second terminal extend from the third side of the housing to a fourth side of the housing, the fourth side being opposite the third side, and wherein the first terminal and the second terminal only pass once through a plane parallel to the fourth side defined anywhere along the first or the second terminal.

In some implementations, the arc splitter includes a plurality of spaced apart plates.

In some implementations, the circuit interrupter includes a trip mechanism electrically connected to the second contact for tripping the circuit interrupter. In some implementations, the circuit interrupter includes a circuit breaker. In some implementations, the fastening feature is a fastener sleeve.

Other objects of the present invention are achieved by providing a circuit interrupter which includes a housing having a first contact and a second contact movable with respect to the first contact; a first terminal located on a first side of the housing; a second terminal located on a second side of the housing, the second side being opposite the first side; an electrical conductor electrically connected to the first terminal and the first contact, the electrical conductor including a first portion located substantially toward the first side of the housing running towards a third side of the housing, the third side being adjacent the first side; a second portion located substantially toward the third side of the housing running towards the second side of the housing; and a third portion connecting the first portion to the second portion, the third portion being at an obtuse angle with respect to the first portion and the second portion; a fastening feature located on a an intersection of a plane defined by the first portion and a plane defined by the second portion; and wherein a length between the first side and the second side is less than about 3.65 inches and a length between the third side and a fourth side is less than about 1.66 inches, the fourth side being opposite the third side.

In some implementations the circuit interrupter includes an arc splitter located adjacent to the first portion and the second portion of the electrical conductor. Optionally, the arc splitter includes a plurality of spaced apart plates. Optionally, the arc splitter is angled with respect to the second side.

In some implementations, the first terminal and the second terminal do not double back on themselves.

In some implementations the circuit interrupter includes a trip mechanism electrically connected to the second contact for tripping the circuit interrupter. In some implementations the circuit interrupter includes a circuit breaker. In some implementations, the fastening feature is a fastener sleeve.

Further objects of the present invention are achieved by providing a circuit interrupter which includes a housing having a first contact and a second contact movable with respect to the first contact; a first terminal located on a first side of the housing; a second terminal located on a second side of the housing, the second side being opposite the first side; and an electrical conductor electrically connected to the first terminal and the first contact. The electrical conductor includes two portions running substantially perpendicular to one another with a connector at an angle other than obtuse; a fastening feature located on an intersection of a plane defined by the first portion and a plane defined by the second portion; wherein a combined length of a length between the first side and the second side and a length between the third side and a fourth side is less than about 5.31 inches, the fourth side being opposite the third side; and wherein the first terminal and the second terminal extend from the third side of the housing toward the fourth side of the housing, and wherein the first terminal and the second terminal only pass once through a plane parallel to the fourth side defined anywhere along the first or the second terminal.

In some implementations, the circuit interrupter includes an arc splitter located adjacent to the first portion and the second portion of the electrical conductor. Optionally, the arc splitter includes a plurality of spaced apart plates. Optionally, the arc splitter is angled with respect to the second side.

In some implementations, the circuit interrupter includes a trip mechanism electrically connected to the second contact for tripping the circuit interrupter. In some implementations, the circuit interrupter includes a circuit breaker. In some implementations, the fastening feature is a fastener sleeve.

Other objects of the invention and its particular features and advantages will become more apparent from consideration of the following drawings and accompanying detailed description.

DETAILED DESCRIPTION OF THE INVENTION

The exemplary embodiment of the present invention is related to a low-profile circuit interrupter. Specifically, the components of the circuit interrupter have been redesigned to allow for a smaller profile. The exemplary embodiment is described with reference to a circuit breaker, but those skilled in the art will understand that the present invention may be implemented on any electrical device that has electrical contacts that can be opened and closed.

Figure 2:
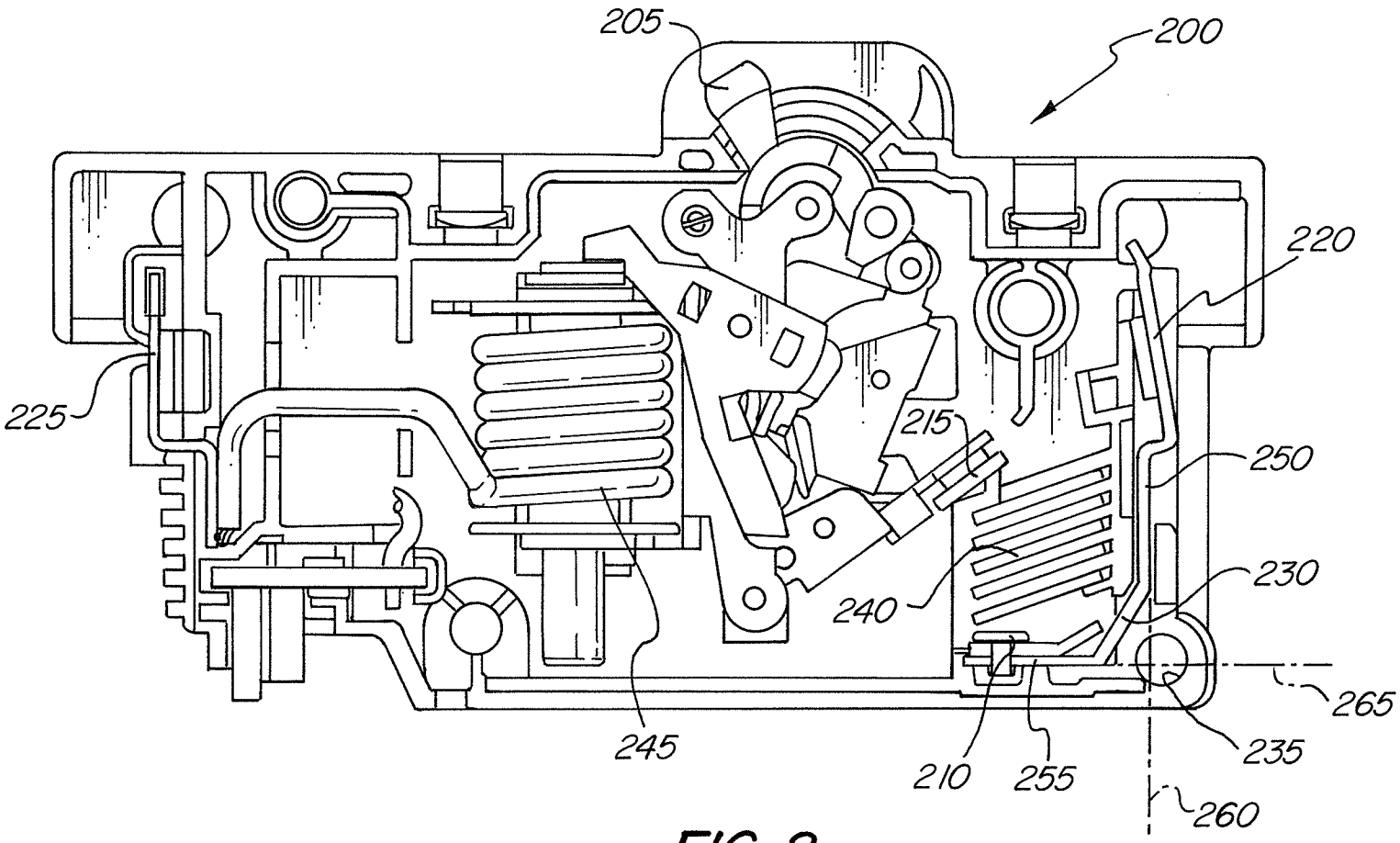
FIG. 2 is side view of an exposed circuit breaker according to the present invention.

As best seen in FIG. 2, a side view of an exposed circuit breaker is shown. Circuit breaker 200 can be used in any commercial or non-commercial application, and may be designed to replace current circuit breakers without the need to modify existing equipment. Circuit breaker 200 is designed to have smaller profile than a standard circuit breaker. As components requiring circuit breakers are being made smaller and smaller, even a tenth of an inch reduction in the size of the circuit breaker can be beneficial. For example, a standard circuit breaker may be 3.939 inches wide by 1.78 inches deep. In contrast, circuit breaker 200 can be 3.645 inches wide by 1.654 inches deep, or even smaller. This reduction in the size of the circuit breaker greatly increases the number of components in which it can be installed.

Circuit breaker 200 has a switch 205 that is used to open or close the circuit breaker. In the closed position, electricity is allowed to freely flow through circuit breaker. In case of an overload in the circuit, trip mechanism 245 may automatically trip switch 205, opening circuit breaker 200. Circuit breaker 200 has a first contact 210 which is fixed to the housing of circuit breaker 200. Circuit breaker 200 has a second contact 215 which is movable with respect to first contact 210. In the closed position, second contact 215 is directly touching first contact 210. If an overload in the circuit occurs, second contact 215 is moved to a position away from first contact 210.

Circuit breaker 200 has a first terminal 220 and a second terminal 225. First terminal 220 and second terminal 225 are located on opposite sides of the housing of circuit breaker 200. Both first terminal 220 and second terminal 225 include a conductor having a straight portion running in an upward direction. Neither conductor has a portion that doubles back on itself. Therefore, if one were to define a plane parallel to the top of the housing of circuit breaker 200, anywhere along first terminal 220 or second terminal 225, neither conductor would pass through the plane more than once. The exclusion of a portion that doubles back on itself allows the circuit breaker to be reduced in width.

Figure 3:
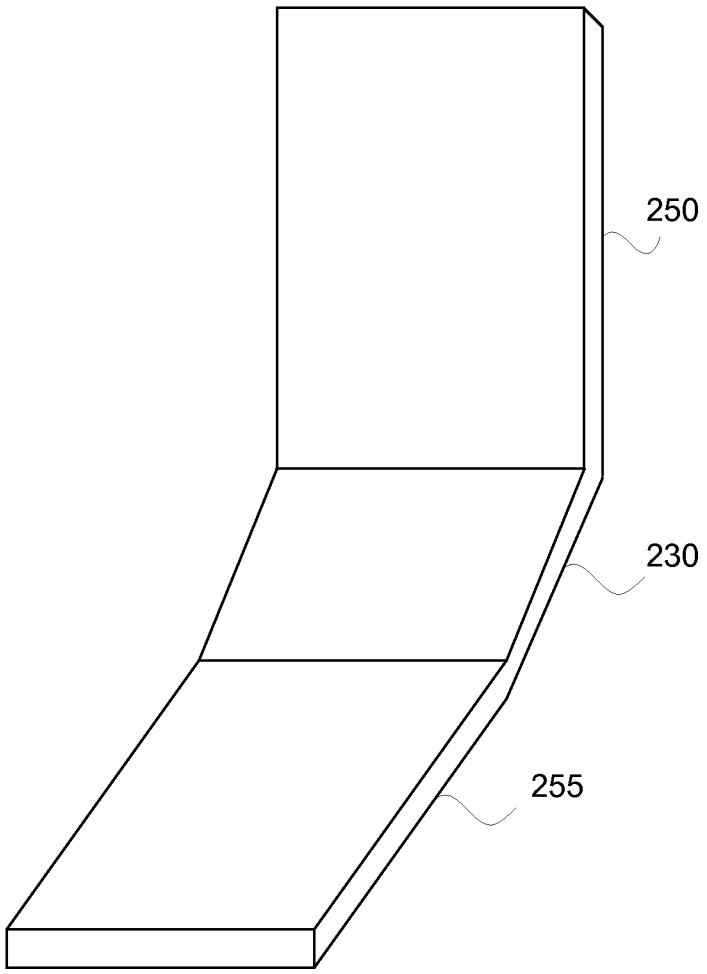
FIG. 3 is a perspective view of a conductor according to FIG. 2.

First terminal 220 is connected to a conductor which has a first portion 250 (FIG. 3) that is substantially parallel to the sides of the housing of circuit breaker 200. The conductor has a second portion 255 (FIG. 3) that is parallel to the top and bottom of the housing of circuit breaker 200. First portion 250 and second portion 255 are connected by an angled portion 230. Angled portion 230 (FIG. 3) is at an obtuse angle with respect to both first portion 250 and second portion 255. Angled portion 230 creates a space between the corner of the housing of circuit breaker 200 and angled portion 230. Such a space does not exist in FIG. 1. The new space allows a fastener sleeve 235 to be placed there. The fastener sleeve can be a screw sleeve, a rivet sleeve, or any other type of sleeve that can be used to close the housing of circuit breaker 200. Second portion 255 is electrically connected to second terminal 225 passing through various components including trip mechanism 245.

As the fastener sleeve can be located between the corner of the housing and angled portion 230, fastener sleeve 235 is able to be located in a plane defined by first portion 250 and a plane defined by second portion 255. Specifically, first portion 250 defines a plane 260 and second portion 255 defines a second plane 265. The imaginary line formed by the intersection of this plane is located between angled portion 230 and the corner of the housing. Because angled portion 230 connects first portion 250 to second portion 255, creating a gap between the angled portion and the corner of the housing, fastener sleeve 230 can be located on this imaginary line. This allows for both a smaller depth and a smaller width of the size of the housing of circuit breaker 200.

In contrast to the above, prior art circuit breakers require a tradeoff between depth and width. Looking again at FIG. 1, fastener sleeve 135 is located below plane 165. This requires circuit breaker 100 to have a larger depth. Fastener sleeve 135 could be placed on plane 165, but it would have to be located to the right of plane 160, which would increase the width of circuit breaker 100. Based on the configuration of circuit breaker 100, there is no way to decrease both the width and the depth utilizing a different placement of fastener sleeve 135, as a decrease in one would increase the other. The modified design of circuit breaker 200 allows for the decrease of both the width and the depth.

Figure 1:
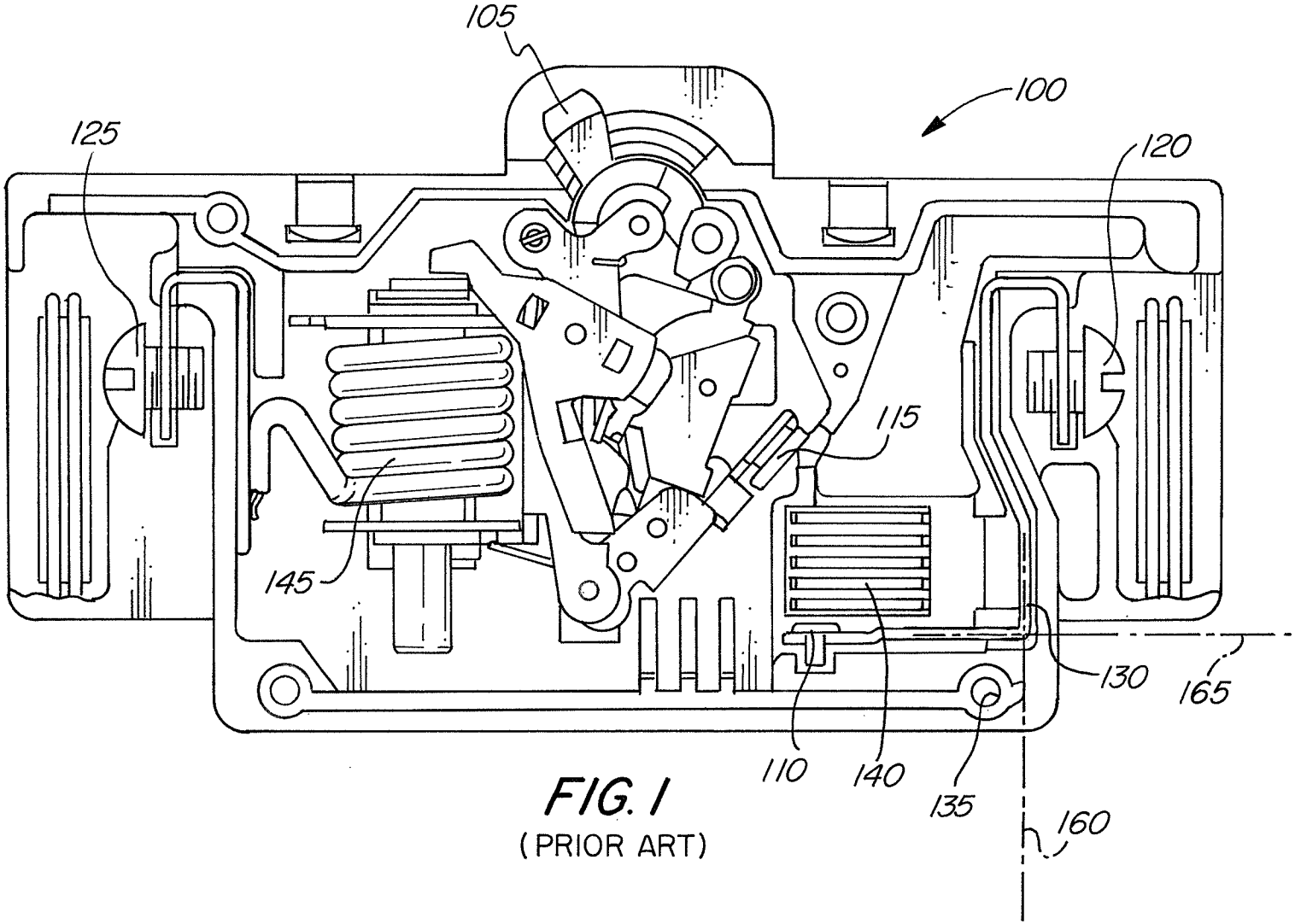
FIG. 1 (PRIOR ART)
FIG. 1 is a side view of an exposed circuit breaker according to the prior art.

Circuit breaker 200 also includes an arc splitter 240. Arc splitter 240 is composed of a plurality of spaced apart plates. Arc splitter 240 is used to cool and quench an arc that is created between first contact 210 and second contact 215 after circuit breaker 200 has automatically tripped due to an overload. Arc splitter 240 is at an angle other than perpendicular with respect to the sides of circuit breaker 200. The angling of arc splitter 240 allows for a smaller profile of the housing of circuit breaker 200. In contrast, the plates of arc splitter 140, as seen in FIG. 1, are perpendicular with respect to the side of the housing. This requires a greater width in the housing to accommodate the entire length of the plates. By angling the plates of arc splitter 240, with respect to the side of the housing of circuit breaker 200, the housing can be made narrower as space does not need to be provided for the entire length of the plates in the direction of the width. Angled plates allows for both the width and the depth of the housing to be used to accommodate the length of the plates.

This device has the advantage in that it has smaller profile, by having a reduced width and depth. This allows the circuit breaker to be used in smaller components where a traditional circuit breaker could not be incorporated. It would be appreciated by those skilled in the art that various changes and modification can be made to the illustrated embodiment without departing from the spirit of the invention. All such modifications and changes are intended to be covered hereby.

Although the invention has been described with reference to a particular arrangement of parts, features and the like, these are not intended to exhaust all possible arrangements or features, and indeed many modifications and variations will be ascertainable to those of skill in the art.

What is claimed is:

1. A circuit interrupter comprising:

a housing having a first contact and a second contact movable with respect to said first contact;

a first terminal located on a first side of said housing;

a second terminal located on a second side of said housing, said second side being opposite said first side;

an electrical conductor electrically connected to said first terminal and said first contact, said electrical conductor being formed as a flat conductor having a width and a longitudinal length, said electrical conductor comprising:

a first portion located substantially toward said first side of said housing running towards a third side of said housing, said third side being adjacent to said first side;

a second portion located substantially toward said third side of said housing running towards said second side of said housing; and a third portion connecting said first portion to said second portion, said third portion being at an obtuse angle with respect to said first portion and said second portion;

wherein said housing has a fastening opening including an axis passing therethrough, the fastening opening located on an intersection of a plane defined by said first portion and a plane defined by said second portion, the intersection comprising a line that is within the fastening opening and parallel with the axis of the fastening opening; and an arc splitter located adjacent to said first portion and said second portion of said electrical conductor, said arc splitter being angled with respect to said second side;

wherein said first terminal and said second terminal extend from said third side of said housing to a fourth side of said housing, said fourth side being opposite said third side, and wherein said first terminal and said second terminal only pass once through a plane parallel to said fourth side defined anywhere along said first or said second terminal.

2. The circuit interrupter of claim 1, wherein said arc splitter comprises a plurality of spaced apart plates.

3. The circuit interrupter of claim 1, further comprising a trip mechanism electrically connected to said second contact for tripping said circuit interrupter.

4. The circuit interrupter of claim 1, wherein said circuit interrupter comprises a circuit breaker.

5. A circuit interrupter comprising:

a housing having a first contact and a second contact movable with respect to said first contact;

a first terminal located on a first side of said housing;

a second terminal located on a second side of said housing, said second side being opposite said first side;

an electrical conductor electrically connected to said first terminal and said first contact, said electrical conductor being formed as a flat conductor having a width and a longitudinal length, said electrical conductor comprising:

a first portion located substantially toward said first side of said housing running towards a third side of said housing, said third side being adjacent said first side;

a second portion located substantially toward said third side of said housing running towards said second side of said housing; and a third portion connecting said first portion to said second portion, said third portion being at an obtuse angle with respect to said first portion and said second portion;

wherein said housing has a fastening opening including an axis passing therethrough, the fastening opening located on an intersection of a plane defined by said first portion and a plane defined by said second portion, the intersection comprising a line that is within the fastening opening and parallel with the axis of the fastening opening; and wherein a length between said first side and said second side is less than about 3.65 inches and a length between said third side and a fourth side is less than about 1.66 inches, said fourth side being opposite said third side.

6. The circuit interrupter of claim 5, further comprising an arc splitter located adjacent to said first portion and said second portion of said electrical conductor.

7. The circuit interrupter of claim 6, wherein said arc splitter comprises a plurality of spaced apart plates.

8. The circuit interrupter of claim 6, wherein said arc splitter is angled with respect to said second side.

9. The circuit interrupter of claim 5, wherein said first terminal and said second terminal do not double back on themselves.

10. The circuit interrupter of claim 5, further comprising a trip mechanism electrically connected to said second contact for tripping said circuit interrupter.

11. The circuit interrupter of claim 5, wherein said circuit interrupter comprises a circuit breaker.

12. The circuit interrupter of claim 5, further comprising a fastener sleeve disposed in the fastening opening.

13. A circuit interrupter comprising:

a housing having a first contact and a second contact movable with respect to said first contact;

a first terminal located on a first side of said housing;

a second terminal located on a second side of said housing, said second side being opposite said first side;

an electrical conductor electrically connected to said first terminal and said first contact, said electrical conductor being formed as a flat conductor having a width and a longitudinal length, said electrical conductor comprising two portions running substantially perpendicular to one another with a connector at an angle other than obtuse;

wherein said housing has a fastening opening including an axis passing therethrough, the fastening opening located on an intersection of a plane defined by said first portion and a plane defined by said second portion, the intersection comprising a line that is within the fastening opening and parallel with the axis of the fastening opening;

wherein a combined length of a length between said first side and said second side and a length between said third side and a fourth side is less than about 5.31 inches, said fourth side being opposite said third side; and wherein said first terminal and said second terminal extend from said third side of said housing toward said fourth side of said housing, and wherein said first terminal and said second terminal only pass once through a plane parallel to said fourth side defined anywhere along said first or said second terminal.

14. The circuit interrupter of claim 13, further comprising an arc splitter located adjacent to said first portion and said second portion of said electrical conductor.

15. The circuit interrupter of claim 14, wherein said arc splitter comprises a plurality of spaced apart plates.

16. The circuit interrupter of claim 14, wherein said arc splitter is angled with respect to said second side.

17. The circuit interrupter of claim 13, further comprising a trip mechanism electrically connected to said second contact for tripping said circuit interrupter.

18. The circuit interrupter of claim 13, wherein said circuit interrupter comprises a circuit breaker.

19. The circuit interrupter of claim 13, further comprising a fastener sleeve disposed in the fastening opening.

* * * * *